United States Patent [19]

Faulkner

[11] 4,313,360

[45] Feb. 2, 1982

[54] HARMONIC GENERATOR FOR ADDITIVE SYNTHESIS OF MUSICAL TONES

[76] Inventor: Alfred H. Faulkner, 1324 Portesuello Ave., Santa Barbara, Calif. 93105

[21] Appl. No.: 134,251

[22] Filed: Mar. 26, 1980

[51] Int. Cl.[3] ..... G10H 1/08; G10H 5/06

[52] U.S. Cl. ..... 84/1.21; 84/1.23; 84/DIG. 11; 84/DIG. 23

[58] Field of Search ..... 84/1.01, 1.22, 1.23, 84/1.11, 1.12, 1.19, 1.21, DIG. 11, DIG. 23

[56] References Cited

U.S. PATENT DOCUMENTS

| | | | |
|---|---|---|---|
| 3,538,806 | 11/1970 | Bunger | 84/1.22 X |
| 4,016,495 | 4/1977 | Machanian | 84/1.19 X |
| 4,070,943 | 1/1978 | Faulkner | 84/1.01 |
| 4,108,039 | 8/1978 | Deutsch | 84/1.19 |
| 4,149,440 | 4/1979 | Deforeit | 84/1.01 |
| 4,256,004 | 3/1981 | Takeuchi | 84/1.21 |

OTHER PUBLICATIONS

Applications of Walsh Functions, 1972 Proceedings of Walsh Functions Symposia, National Technical Information Service, U.S. Department of Commerce, Sringfield, Virginia 22151.

*Primary Examiner*—Stanley J. Witkowski

[57] ABSTRACT

Each harmonic of the ten provided is represented by a pair of binary-valued signals; one having the form A ⊕ B ⊕ C, where A, B and C are octavely related square waves, and the other being a square wave like C. Each pair of signals is coupled to a resistive divider by coupling elements in an additive relation under control of an individual adjustable voltage source. The coupling elements are weighted so as to minimize distortion in the signal resulting from the mixture. The resistive divider preemphasizes the signals representing each harmonic to compensate for a voltage controlled filter in the audio output used to eliminate high order distortion components. In one embodiment a ÷3 counter followed by a binary counter provides the binary-valued signals for harmonics of order $0.5\times2^n$, where n is an integer, and a binary counter driven in parallel with the ÷3 counter provides the binary-valued signals for harmonics of order $1.5\times2^n$. A read only memory provides the binary-valued signals for harmonics whose order is prime. In a second embodiment all of the binary-valued signals are provided by a read-only memory.

10 Claims, 5 Drawing Figures

FIG. 1
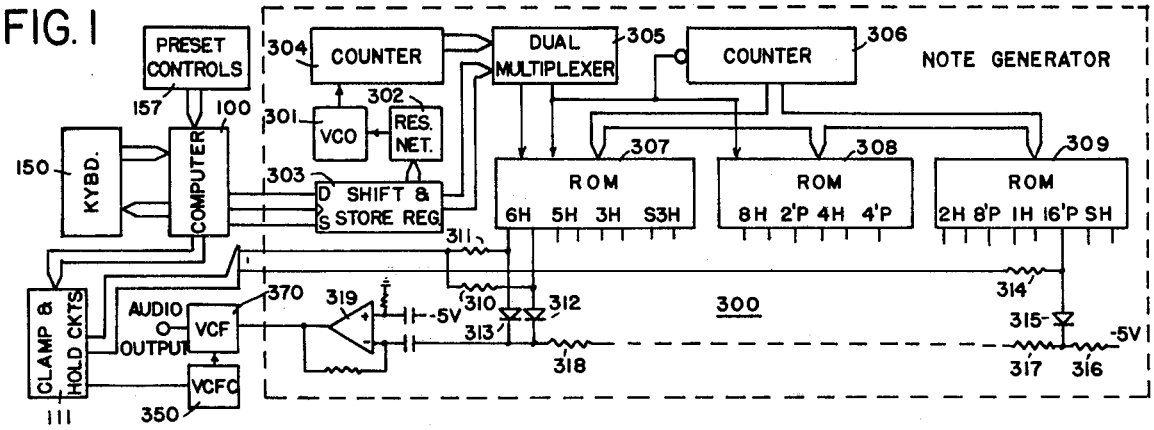
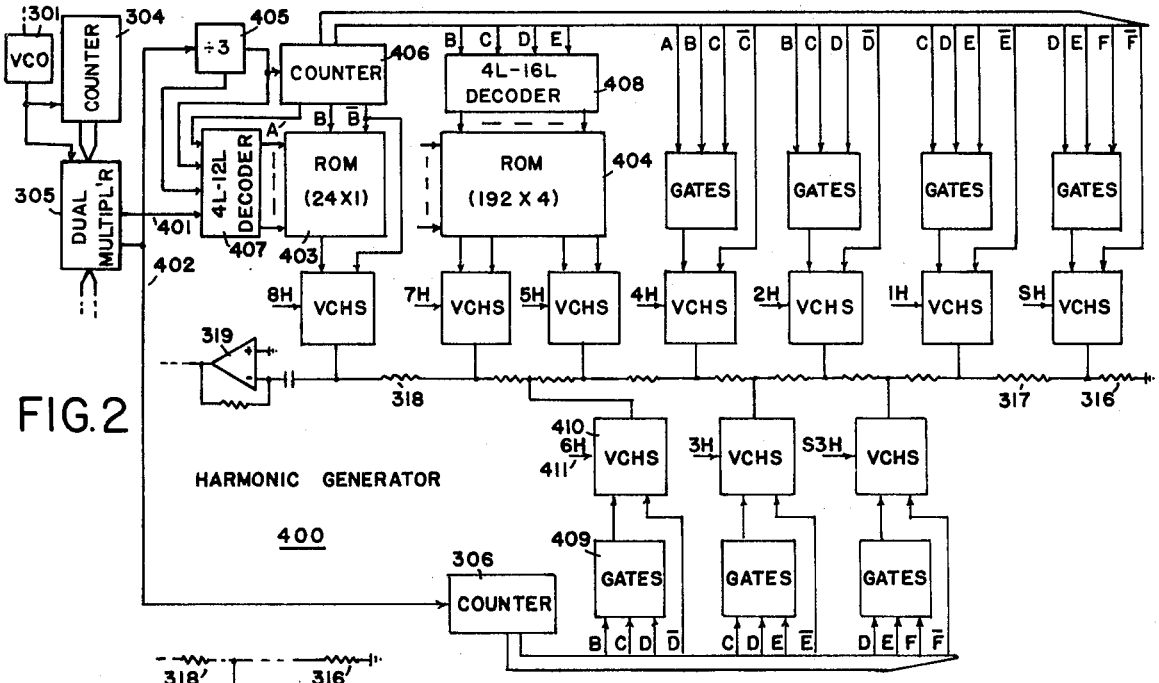
FIG. 2
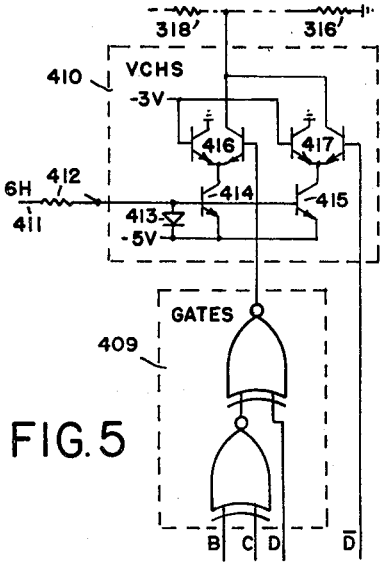
FIG. 5
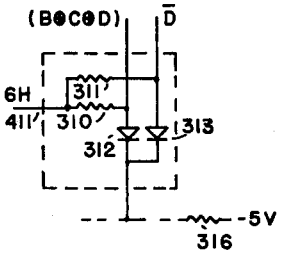
FIG. 3
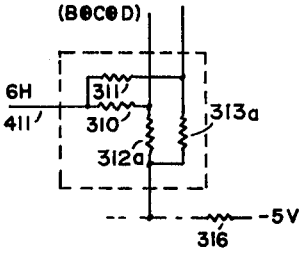
FIG. 4

HARMONIC GENERATOR FOR ADDITIVE SYNTHESIS OF MUSICAL TONES

BACKGROUND OF THE INVENTION

In 1923, J. L. Walsh investigated a set of functions which can be employed in waveform synthesis schemes analogous to the Fourier synthesis methods employing sines and cosines. The Walsh waveforms are binary valued sequences of bits which repeat over a basic interval. He published a paper entitled "A Closed Set of Normal Orthogonal Functions" describing these functions in the *American Journal of Mathematics,* vol. 45, p. 5 (1925). More recently, R. B. Lackey described Walsh functions in a paper entitled "The Wonderful World of Walsh Functions" presented at the Walsh Functions Symposium and published in the 1972 Proceedings, "Applications of Walsh Functions." AD-744 650. In a set of Walsh harmonics, or functions, there is a pair of rectangular waveforms, or bit patterns, for each harmonic. Each such pair of waveforms has the same bit sequence, but they are displaced from each other in analogous fashion to the sine and cosine components of a Fourier series. Any continuous repetitive waveform can be synthesized by addition of Walsh harmonics in appropriate proportions in analogous fashion to synthesis with Fourier components. Synthesis using Walsh functions appears to be more attractive than using Fourier components due to the greater ease of generating the Walsh functions with digital circuits than the Fourier harmonic components. Despite this apparent advantage, additive synthesis using Walsh functions has not found favor in musical instruments. One of the principle objections to this approach is that the coefficients for the Walsh harmonics cannot be selected independently, because each harmonic contains undesirably large amounts of many Fourier harmonics. Consequently, a simultaneous solution for all of the Walsh coefficients is required. This is a chore for a computer to do rather than a musician.

An additive synthesis system of the Fourier series type, using digital waveforms for each harmonic component, was disclosed by the present inventor in U.S. Pat. No. 4,070,943, entitled "Improved Organ Keying System", issued Jan. 31, 1978. The circuit arrangement used to generate the harmonic waveforms comprised a resistive path between a square wave tone source, in the form of a binary divider, and a tone utilization circuit; and a transistor switch connected in the resistive path so as to increase the absolute value of tone current during the second and third quarters of each half cycle. The transistor switch was operated by an exclusive-or gate having its inputs driven by divider stages one and two octaves above that used as the square wave tone source. By appropriate choice of the relative magnitudes of the steps in the resulting waveform, the third and fifth harmonics were effectively eliminated. The remaining high order harmonics were effectively eliminated by a low pass filter, or integrator, in the utilization circuit. One binary divider, or counter, was provided for the harmonics of order $0.5\times2^n$, where n is an integer; a second was provided for harmonics of order $1.5\times2^n$; and a third was provided for the fifth harmonic. A rate multiplier was used to establish the required clock rates for the three dividers. The resulting harmonic components were essentially pure sine waves, whereby additive synthesis in the classical Fourier manner using a single control to select the desired strength, or coefficient, of each harmonic was provided.

SUMMARY OF THE INVENTION

The present invention is an improvement on that described above in a number of ways. In the present system there is no need for the transistor switches; instead a ROM (read-only memory), or equivalent logic circuitry, produces an $A\oplus B\oplus C$ bit pattern that is mixed with a square wave, using appropriate weighting, to provide the desired waveshape. The rate multiplier is omitted and instead the first two binary dividers are driven from a common source with a $\div3$ counter preceding the first divider; whereby harmonics of order $1.5\times2^n$ having absolutely uniform segments, exactly like the fundamental, are produced. The fifth and seventh harmonics are produced by a ROM which produces both the $A\oplus B\oplus C$ and the square wave (C) bit patterns. Irregularity in the length of these segments is minimized by using a large capacity memory which provides much higher resolution that the rate multiplier used previously.

In order to minimize the chip size needed to fabricate the note generator in a single integrated circuit, an alternative circuit for coupling the signal sources to the tone utilization circuit is disclosed. The alternative circuit uses a pair of differential stages as current switches for each harmonic and a pair of weighted current sources for the two stages with an individual control for each pair of current sources.

An alternative version of the harmonic generator, suited for implementation with off-the-shelf components, uses a single binary divider to drive a set of programmable ROMs (PROMs) which produce both the $A\oplus B\oplus C$ and the square wave (C) bit patterns for all of the harmonics.

BRIEF DESCRIPTION OF THE DRAWINGS

FIG. 1 is a schematic of a version of the harmonic generator, in block diagram form, suited for implementation with commercially available parts.

FIG. 2 is a schematic of an alternative version of the harmonic generator, in block diagram form, best suited for implementation as a single custom integrated circuit.

FIGS. 3, 4 and 5 are detailed circuit diagrams of alternative forms of voltage controlled harmonic synthesizers (VCHS) for use in FIGS. 1 or 2.

DESCRIPTION OF THE PREFERRED EMBODIMENT

The note generator 300, shown in FIG. 1, is identical to that shown in a co-pending application entitled, "Capture System for an Electronic Musical Instrument", Ser. No. 134,250, filed Mar. 26, 1980 by the present inventor, and now U.S. Pat. No. 4,283,984.

Corresponding reference characters have been used to facilitate cross-reference for a fuller description of exemplary circuitry that interfaces with the note generator, but the invention is not limited to any particular form of instrument. As mentioned previously, this note generator is an improvement on one previously disclosed by the present inventor in U.S. Pat. No. 4,070,943. In the improved system there is no need for the transistor switches; instead a ROM (read-only memory) generates a pair of binary signals for each harmonic which provide the desired waveshape when mixed in additive relation with appropriately weighted resistors. The two waveshapes of each pair of signals are (1) a square wave at the harmonic frequency and (2) an exclusive-or function; which correspond with the Walsh functions for the fundamental and third harmonics, respectively. The size of the ROM used in the illustrative embodiment was determined in part by what is commercially available. Texas Instruments type 74S470 (256W×8B) was chosen for ROM 307 and type 74S188 (32W×8B) was chosen for ROMs 308 and 309. These are read—only memories that are progammable by blowing fusible links (PROMs).

There must be an integral number of cycles of each harmonic for each pass through the memory. Thus there must be 3 cycles of S3H (sub-third harmonic), 6 cycles of 3H, 10 cycles of 5H, and 12 cycles of 6H programmed in ROM 307. Since the top note of the keyboard is $C_7$ with a fundamental pitch of 2093 hz, the memory must be accessed (2093÷2)W times per second, where W is the number of words in the memory. For W=256, the access rate is 268 k/sec. The circuitry has been arranged to access alternate locations for the top octave, effectively making W=128, which reduces the oscillator frequency to a value more suitable for the preferred VCO (Teledyne 9400).

Referring now to FIG. 1, VCO 301 operates continuously at a selected one of 12 frequencies between 70,969 hz and 133,952 hz. The frequency is determined by a network of precision resistors 302 which are switched between −5 volts and +5 volts by the shift-and-store register 303. When a note is selected by key-board 150, the computer 100 sends pitch data to the shift-and-store register, such as 303, of a selected note generator. Register 303 also controls a dual multiplexer 305 to select octave sub-multiples of the VCO frequency from counter 304 to drive the second counter, or divider, 306 and ROMs 307 and 308. For the top octave, the LSB of the address input of these ROMs is held constant and the 2nd LSB is connected directly to the top output of counter 304. Since there is then one memory access for each VCO cycle, this connection provides the required 134 k/sec access rate of 128 locations for the highest note, $C_7$. For the next lower octave the LSB is connected to the top output, thereby providing a 134 k/sec access rate of 256 locations for the next highest C note, $C_6$. For each succeeding lower octave the LSB is connected to correspondingly lower stages of counter 304. ROM 309 produces output signals at ¼ the frequency of ROM 308., hence its address inputs are connected to correspondingly lower frequency outputs of counter 306.

The four pulse type waveshapes (designated x'P) each require only one bit of each memory word. Two locations of the 16'P bit store 1's and 30 locations store 0's. The 16'P output, (all are open-collector type) is connected through resistor 314 to an output of clamp-and-hold 111 and through a diode 315 to a resistive divider network 316–318. The divider network scales the inputs to pre-amp 319 so as to compensate for the roll-off of the voltage controlled filter (VCF) 370, which is a tracking type of damped integrator. The diode 315 can be replaced by a resistor, but the diode is preferred because it provides a threshold above the $V_{SAT}$ output of the ROMs, which are bipolar devices. If ROMs having field-effect type output transistors are used there is no need for this diode.

The nine sine type waveshapes each require two bits of each memory word. One of these bits is programmed with a square wave pattern; for example, the SH has one bit with 16-1's followed by 16-0's. The other bit is programmed with the inverted exclusive-or function ($\overline{f \oplus 2f \oplus 4f}$), where f is the frequency of the square wave. Thus the other bit of SH has 4-1's, 8-0's, 4-1's, 4-0's, 8-1's, and 4-0's in succession. If the first bit is designated A and the other B, the sequence of logical combinations occurring in one cycle is $A\overline{B}$, AB, $A\overline{B}$, $\overline{A}B$, $\overline{AB}$, and $\overline{AB}$. The two ROM outputs for a given harmonic are each connected through a resistor, such as 310 and 311, to a single output of clamp-and-hold 111, and through a diode, such as 312 and 313, to the resistive divider 316–318. The resistors 310 and 311 are chosen to have a ratio of approximately 2.5:1, whereby the ratio of the peak signal to the first step in the resulting AC waveform at the output of amplifier 319 is approximately 2.3:1. As fully described in the prior U.S. Pat. No. 4,070,943, mentioned earlier, this waveshape is practically devoid of 3rd and 5th harmonics and contains no even harmonics. Alternatively, the resistors 310 and 311 may be equal and the desired weighting may be accomplished by connecting diodes 312 and 313 to different points on the resistive divider 316–318. The amplitudes of each of the harmonics, SH-8H, and each of the pulse waveshapes, 16'P-2'P, is independently controlled by a corresponding output of the clamp-and-hold 111.

The harmonics produced by ROM 307 are not identical to that described above for the SH since these harmonics are not related to SH by a factor $2^n$, where n is an integer. However ROM 307 is programmed to provide waveshapes having 8 steps/cycle with step changes as near the desired ⅛ cycle intervals as possible with the 256 memory words available. The results have been found to be perfectly satisfactory for the intended purpose.

An alternative allocation of memory words which provides uniform width steps for the S3H, 3H, and 6H is possible if two different waveshapes are used. If the 8H has 6 steps/cycle and the 6H has 8 steps/cycle, both can be provided in a 48 word memory with no variations between the cycles of either one. Their submultiples may have proportionately more steps, or proportionately fewer words. The same sequence of logical combinations ($A\overline{B}$, AB, $A\overline{B}$, $\overline{A}B$, $\overline{AB}$, and $\overline{A}B$) is produced for the six steps/cycle waveform, the only difference being that each combination has a duration of 1/6 cycle. The reason the embodiment described above is preferable is because the 6 step waveform cannot be proportioned so as to effectively cancel both the 3rd and 5th harmonics. By choosing resistors 310 and 311 to have a ratio of 3:1 the 3rd harmonic is cancelled in the 6 step waveform. The ratio of the peak signal to the first step in the resulting AC waveform at the output of amplifier 319 is 2:1 in this case.

The signals developed across divider 316–318 are amplified and level-shifted by pre-amp 319 before reaching the input of VCF 370, which is a conventional damped integrator (a low-pass filter with 6 db/octave roll-off). The cut-off frequency $f_{col}$ of filter 370 varies directly with the voltage supplied to the input of VCF controller 350.

All of the signals are attenuated by the filter in inverse proportion to their frequency, hence the pulse waveforms become sawtooths and the harmonic waveforms become practically pure sine waves. The resistive divider 316–318 pre-weights the digital signal representations to compensate for the attenuation of the desired fundamental signals. As the envelope decreases from its peak value, $f_{col}$ decreases proportionately. The output of filter 370 accordingly decreases proportionately with no change in the waveform of the signals since they all lie on the constant slope of 6 db/octave. Hence, filter 370 actually performs the function usually performed by a VCA in addition to its filter function.

ALTERNATIVE HARMONIC GENERATOR

The note generator 300 described above is an efficient way to implement a set of harmonics using commercially available parts, but is not the optimum arrangement for implementation in a single custom integrated circuit. FIG. 2 shows an alternative circuit arrangement that is suited to such implementation, and has other advantages as well. Since there are no outputs other than simple harmonics shown in FIG. 2, it has been labeled a harmonic generator.

The VCO 301 must operate at frequencies between 106 khz and 201 khz in this case. When a note in the top octave is selected lead 402 is connected directly to the VCO and lead 401 is held low, whereby ROMs 403 and 404 access every 2nd location, just as 307 and 308 in FIG. 1 do. For all lower octaves lead 401 has a signal on it that is one octave above that on lead 402. The two outputs of ÷3 counter 405, together with lead 401 and the A output of counter 406, are used to select 1 of 12 outputs of decoder 407. These outputs are combined with the B and $\overline{B}$ outputs of counter 406 to form ROM 403, organized as a 24×1 memory. The same 12 outputs are combined with the 16 outputs of decoder 408 to form ROM 404, organized as a 192×4 memory.

The bit pattern produced by ROM 403 is 000111111000111000000111. The symmetry of this pattern is degraded when every other location is omitted; but, since the eighth harmonic is greater than 8850 hz when this occurs, the resulting added frequency components lie above 19 khz, which is beyond the audible range. In the case of ROM 404, there is some unavoidable dissymmetry, even when all locations are accessed, which is not seriously worsened by skipping alternate locations for the top octave. Since the B output of counter 406 is the frequency of the eighth harmonic, it is not necessary to generate a square wave in ROMs 403 to mix with the exclusive-or-function it generates. In the case of ROM 404, rectangular wave having crossing points matching the corresponding exclusive-or-functions are generated to obtain the maximum cancellation of undesired frequency components when these signals are mixed. The exclusive-or signals for all of the remaining harmonics are generated by gate circuits, such as 409, which are connected to outputs B-F of counter 306 for harmonics of order $1.5\times2^n$. FIG. 5 shows the detailed connections of the cascaded exclusive-or gates in box 409, for example.

The exclusive-or function obtained either from the ROMs or the gates, such as 409, is mixed with a corresponding square wave either from the ROMs or the counters, such as the $\overline{D}$ output of counter 306, in a voltage controlled harmonic synthesizer (VCHS), such as 410, to obtain a digital approximation to a sine wave in resistive divider 316–318. This stepped waveform is modified by the damped integrator 370 (FIG. 1) into a waveform, consisting of straight line segments having either of two slopes of either polarity, closely approximating a sine wave.

The VCHS, such as 410, can be any of the alternative forms shown in FIGS. 3–5. FIG. 3 is the same form as shown in FIG. 1 described earlier. It was also stated previously that the diodes 312 and 313 could be replaced with resistors, as here shown by resistors **312*a* and 313*a* in FIG. 4, when the sources use field effect devices. In both FIGS. 3 and 4 the signal sources must be open-collector, or open-drain in the case of field effect transistors. The control input 411 is connected to a corresponding output of clamp-and-hold circuits 111 (FIG. 1**). In a conventional instrument the preset, or voice, controls would be connected directly to the VCHS control inputs.

The coupling resistors, such as 310 and 311, would take considerable area on a semiconductor chip if integrated together with the gates, ROMs etc. The alternate VCHS shown in FIG. 5 overcomes this problem by eliminating the integrated resistors. Instead, an external resistor 412 is connected between the adjustable voltage source, connected to lead 411, and a current mirror comprising diode 413 and transistors 414 and 415. The geometry of these transistors is scaled so that their collector currents are in the ratio of 2.5:1. The resistor 412 and diode 413 may also control corresponding pairs of transistors in other harmonic generators in a polyphonic system. Transistors 414 and 415 supply currents to differential stages 416 and 417, respectively. Current from the free collectors of 416 and 417; which is chopped by the output signals from 409 and from $\overline{D}$, respectively, is combined and fed to the resistive divider 316–318.

Since the outputs of either of the stages 416 and 417 can be inverted by interchanging the collectors of the stage, either polarity of signal can be provided at their inputs. The output of gates 409 can be inverted by inverting any one of the inputs B, C or D, or by inverting all three inputs. All such variations are simple equivalents to the connections illustrated.

Although the invention has been described and illustrated in detail, it is to be understood that the same is by way of illustration and examply only and is not to be taken by way of limitation, the spirit and scope of the invention being limited only by the terms of the appended claims.

I claim:

1. In an electronic organ of the additive-synthesis type, a tone generator for producing a series of harmonics comprising:

a signal generator including a counter and having two binary output bits for each harmonic, a tone signal utilization circuit, an adjustable voltage source for each harmonic, coupling elements connecting each of said voltage sources and the corresponding two outputs of said signal generator to said utilization circuit in an additive relation, a tone signal source driving the counter of said signal generator, said signal generator producing output bit patterns such that each pair of bits is a digital representation of the corresponding harmonic, and said coupling elements being weighted so as to minimize distortion of the tone signals produced in said utilization circuit.

2. An electronic organ as claimed in claim 1 wherein said signal generator includes a read-only memory for generating at least one of the binary output bits for at least one of the harmonics.

3. An electronic organ as claimed in claim 1 wherein said coupling elements comprise resistors.

4. An electronic organ is claimed in claim 1 where said coupling elements comprise transistor current sources.

5. In an electronic musical instrument, a voltage controlled harmonic synthesizer comprising:

a first signal providing octavely related square wave signals A, B and C a second signal source deriving a signal $A \oplus B \oplus C$ from said first signal source a tone signal output, an adjustable voltage source, coupling elements connecting signal C from said first source and the signal $A \oplus B \oplus C$ from said second source to said output in additive relation under control of said adjustable voltage source, said coupling elements being proportioned so as to minimize distortion of the tone signal produced in said output.

6. An electronic musical instrument as claimed in claim 5 wherein said coupling elements comprise;

a pair of differential amplifiers each having an input connected to a corresponding one of said signal sources and an output connected to said tone signal output, and a current source for each of said differential amplifiers controlled by said adjustable voltage source.

7. An electronic musical instrument as claimed in claim 5 wherein said coupling elements comprise resistors.

8. In an electronic organ of the additive synthesis type, a tone generator for producing a series of harmonics comprising:

a tone signal source, a first binary counter and a divide-by-three counter driven by said source, a second binary counter driven by said divide-by-three counter, a plurality of gating circuits each having three inputs A, B and C connected to successive stages of said binary counters, said gating circuits producing output signals of the form $A \oplus B \oplus C$, and a plurality of harmonic synthesizers connected to the outputs of said gating circuits and to said binary counters, whereby harmonics of order $0.5 \times 2^n$ where n is an integer are produced by the synthesizers connected to said second binary counter and harmonics of order $1.5 \times 2^n$ are produced by the synthesizers connected to said first binary counter.

9. An electronic organ as claimed in claim 8 including:

a read-only memory addressed in part by one of said counters and producing an output of approximately the same form as said gating circuits, and a harmonic synthesizer connected to the output of said memory and to the associated binary counter.

10. An electronic organ as claimed in claim 8 including:

a read-only memory addressed in part by one of said counters and producing one output of approximately the same form as said gating circuits and a second output of approximately the same form as the associated counter, and a harmonic synthesizer connected to the outputs of said memory and producing a harmonic of order n where n is a prime number.

* * * * *